United States Patent [19]

Camp

[11] 4,167,841

[45] Sep. 18, 1979

[54] FOIL PACKING APPARATUS AND METHOD

[75] Inventor: Johannes P. Camp, Venlo, Netherlands

[73] Assignee: B.V. Machinefabrick "Verwachting", Wormer, Netherlands

[21] Appl. No.: 683,992

[22] Filed: Jun. 2, 1976

[51] Int. Cl.[2] ..... A65B 11/08; B65B 13/22

[52] U.S. Cl. ..... 53/399; 53/441; 53/466; 53/556; 53/586; 53/228

[58] Field of Search ..... 53/30 R, 184 R, 198 R, 53/228, 229, 441, 466, 556, 586, 399

[56] References Cited

U.S. PATENT DOCUMENTS

| | | | |
|---|---|---|---|
| 3,589,091 | 6/1971 | Cloud | 53/30 X |
| 3,596,434 | 8/1971 | Zelnick | 53/198 R |
| 3,946,539 | 3/1976 | Noack | 53/198 R |
| 3,955,339 | 5/1976 | Kiener et al. | 53/228 X |

*Primary Examiner*—John Sipos
*Attorney, Agent, or Firm*—Irvin A. Lavine

[57] ABSTRACT

Apparatus for wrapping a stretchable foil around goods to be packed, comprising an upper supply roller for a packing foil with a hold-down and stretch beam and a lower supply roller for a packing foil with guide and stretch means. Clamping, sealing and cutting means are provided for effecting a seal and cutting the tensioned foil wrapped around the goods, wherein the lower clamping means with the lower guide and stretch means are adapted to effect a differential tension in the lower foil web in such a manner that the tension in the foil web between guide means and goods to be packed is considerably greater than between guide means and clamping means. A method of wrapping in which a differential tension is effected in a lower foil web in a package wrapping operation between the goods and a guide, and between the guide and a clamp.

6 Claims, 2 Drawing Figures

FOIL PACKING APPARATUS AND METHOD

Figure 1:
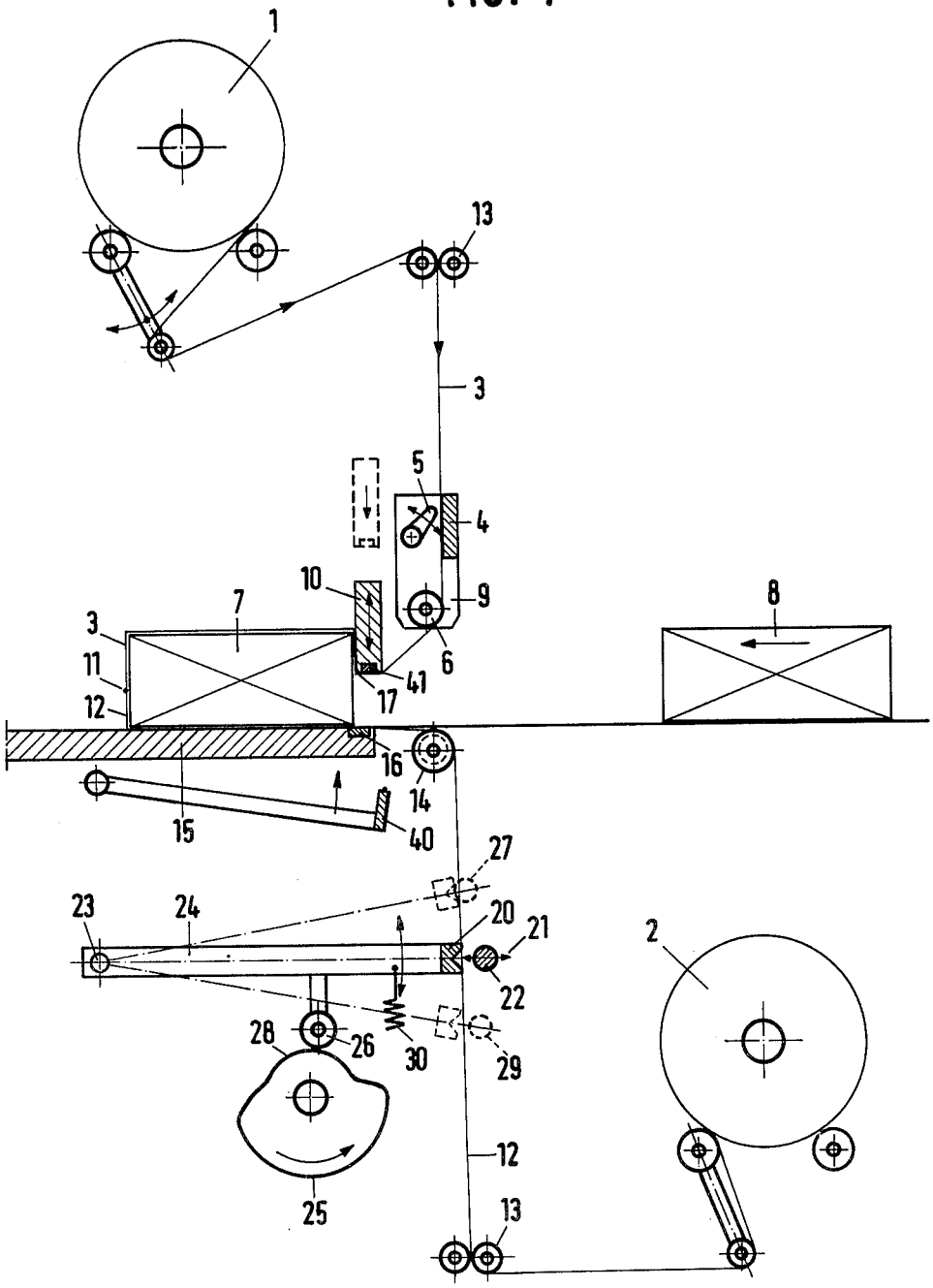

This invention relates to an apparatus and related method for wrapping a stretchable foil about goods to be packed, which apparatus comprises a frame including an upper supply roller for a packing foil and a movable holddown and stretch beam along which the upper foil is passed to a receiving station for goods to be packed, further including a lower supply roller for packing foil, a lower guide means between the lower foil supply roller and the receiving station for goods to be packed, and also between guide roller and supply roller stretching and tensioning means, while furthermore directly adjacent to the receiving station for the goods to be packed clamping, sealing and cutting means are provided, between which the two foil webs are passed and wound around goods to be packed, and which are adapted to effect a seal in the tensioned foil wrapped around the goods and to cut same.

When a foil is tensioned it is considerably stretched. The clamping and cutting means are always located as closely as possible to the goods to be packed, while the tensioning means, in the tensioning or stretching position, are usually at a considerable distance from the sealing zone. The foil between the stretching or tensioning means and the sealing and cutting means is in this way prestretched and subsequently used for packing a next quantity of goods. Since tensioned foil assumes only slowly its original dimensions or not at all, at least a great part of the foil to be used for the next quantity of goods to be packed is already prestretched, which causes problems in the subsequent stretching and packing.

The object of the invention is to provide an improved apparatus of the type described above, and related method with which for the greater part only foil is stretched which is directly used for the packing then formed.

To this end, according to the invention, the lower clamping means with the lower guide and stretch means is adapted for effecting a differential tension in the lower foil web in such a manner that the tension in the foil web between guide means and goods to be packed is considerably greater than between guide means and clamping means.

The lower clamping means is movable between a foil clamping position and a foil stretching position, and can be suitably connected to a guide roller for the lower foil web in such a manner that the peripheral speed of the guide roller is greater than the rate of displacement of the lower clamping means towards the stretching position. A pulling member converts a longitudinal displacement of the clamping means into a rotation of the guide roller. A suitable construction is obtained when the lower guide roller is provided with a sprocket wheel, the diameter of which is smaller than the roller itself, wherein a chain running on this sprocket wheel is connected to the lower clamping means, while between the sprocket wheel and guide roller a freewheel clutch is provided in such a manner that only when the lower foil web is tensioned by means of the lower clamping means is the guide roller entrained by the sprocket wheel.

Further particulars of the invention may also appear from the following description of one embodiment.

Figure 2:
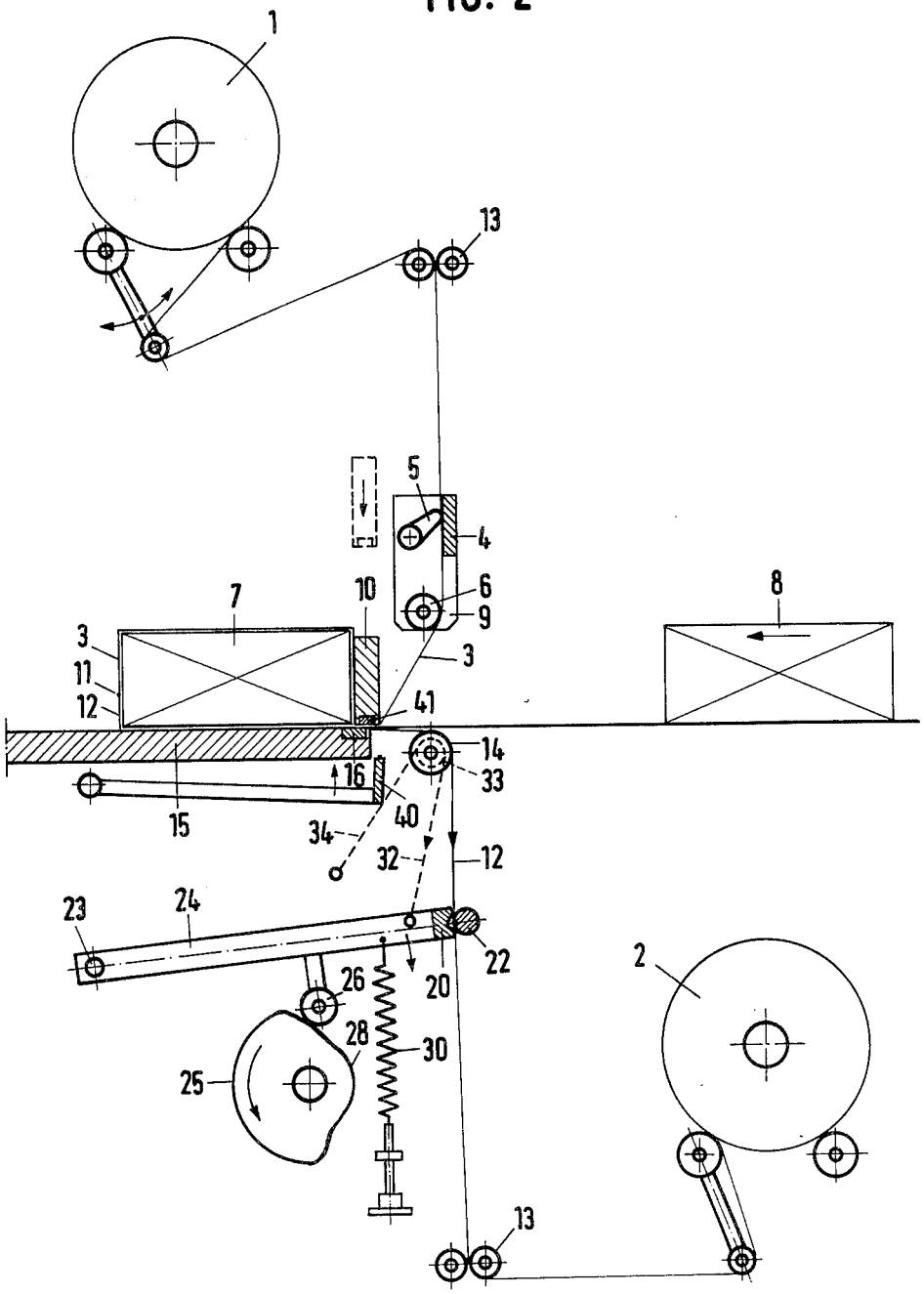

FIGS. 1 and 2 show diagrammatically in side elevational view a construction of an apparatus according to the invention in two stages.

The apparatus comprises an upper supply roller 1 and a lower supply roller 2 of foil material, such as of transparent polyethylene, polypropylene, PVC or the like. From the upper supply roller issues a foil web 3. This web passes along a clamping plate 4 against which a clamping strip 5 is pivotable. This clamping strip 5 is wider than the widest foil material 3 to be handled, while the clamping strip or the clamping plate 4 or both of them can be provided with a resilient coating to clamp the foil material uniformly. The foil material 3 subsequently passes a guide roller 6. Guide roller 6 with clamping plate 4 and clamping strip 5 are mounted on a frame portion 9 and are jointly adjustable to a height depending on the height of the goods 7 to be packed, in such a manner that the goods can be transported precisely below roller 6 by movement to the left from a starting position 8. Along rear of the the goods 7 to be packed there is provided a hold-down and stretch beam 10 which is movable in the vertical direction. In the starting position this beam 10 is at a level corresponding with that of roller 6, or higher, so that the goods to be packed can be transported from the right by known per se means, not shown. The foil web 3 passes below the hold-down and stretch beam 10 and above the goods 7 to be packed. Adjacent location 11 there is a seal, formed during the handling of a previous packing, between foil web 3 and a second foil web 12, coming from the lower supply roller 2. Said lower foil web 12 passes via a roller 13 to a guide roller 14. The upper generatrix of this guide roller 14 is located approximately adjacent to the upper part of a machine plate or machine surface 15, on which the goods 7 to be packed are supported. There is disposed over the full width of the plate 15 a rubber or other elastic pad 16, adapted to cooperate with a slightly downwardly extending clamping ledge 17 of the hold-down and stretch beam 10. Between rollers 13 and 14 there is disposed a clamping means for the lower foil web 12. This clamping means comprises a grip 20 and a grip 22 which is movable in the direction of arrow 21. Upon movement of the movable grip 22 to the left, in the drawing, the foil web 12 will be clamped along two lines against a V-shaped recess in grip 20. Grips 20 and 22 are mounted on arms 24 which are pivotable at 23, so that these arms with grips can perform an up-and-down movement. To this end use is made of a cam disc 25 over which a roller 26 on one of the arms 24 is movable. Normally, arms 24 will be maintained in a highest position 27 as shown in FIG. 1 when roller 26 runs on a high portion of cam disc 25. When a recess or reduced curve portion 28 is reached, arms 24 will move downwards, by the action of an adjustable spring 30, to a lower position 29. Spring 30 determines the tension in the lower part of the foil. Grip 20 is connected to guide roller 14 by means of a chain 32. To this end, guide roller 14 includes a small sprocket wheel, the diameter of which is considerably, for example 50%, smaller than that of roller 14. The part 34 of the chain running from this sprocket wheel 33 can either be spring-loaded or have a weight, so that the chain is always kept taut and as a consequence of which the sprocket wheel is moved in counter-clockwise direction in FIG. 2 upon upward movement of arms 24. Between sprocket wheel 33 and guide roller 14 there is provided a freewheel clutch in such a manner that guide roller 14 is only entrained by arms 24 via chain 32 and sprocket wheel 33 if arms 24 move downwardly for tensioning the lower foil web 12.

The drive of the hold-down and stretch beam 10 can be effected in any desired way, for example by means of a cam disc on a central drive shaft, but a pneumatic, hydraulic or other drive is likewise possible. It is only important that upon downward movement of the beam 10, it interrupts its vertical movement at a slight distance, for example 1 mm, above the plane of the machine plate 15. At some predetermined distance above this rest position the clamping strip 5 is operated, for instance mechanically, pneumatically or hydraulically. As soon as the upper foil 3 is clamped between parts 4 and 5, the foil material is stretched when beam 10 moves farther downwardly, the degree of stretch being determined by the distance over which beam 10 moves downwardly. The stresses in tension in foil 3 will be greatest adjacent beam 10. Under the influence of friction, especially below ledge 17 and at the edges of the goods 7 to be packed the stress in tension will always diminish in the direction of the lower supply roller 2. It is observed that both supply rollers can be provided in a known manner with mechanisms for keeping the tension in the foil webs substantially constant and at any rate at a low value in case of sudden unrolling when, for example, the goods 7 to be packed are slid from a starting position not shown—when the sealed foils run almost directly from guide roller 6 to guide roller 14—to the left into the position shown in FIG. 1. In addition conventional brake means may be present to prevent unrolling under the influence of inertia forces, especially in case of full rollers.

After beam 10 has come to its rest position at some distance above the machine plate 15 and the upper part 3 of the foil has been subjected to the desired tension, the lower tensioning means is actuated. Arms 24 with grips 22 and 20 are originally in the upper position 27, in which the movable grip 22 is held against the fail 12 to prevent the stresses in tension created under the influence of the upper beam 10 from propagating to the supply roller 2. Arms 24 subsequently move downwardly with grips 20 and 22. With said downward movement the guide roller 14 will be rotated under the influence of chain 32. The peripheral speed of said roller 14 is, for example, double the rate of displacement of grips 20 and 22. The desired stress in tension in the lower foil part will thereby be exerted between guide roller 14 and the goods 7 to be packed. As grips 20 and 22 move less rapidly downwardly than corresponds with the peripheral speed of roller 14, the tension in this part of the foil will decrease, so that slip can occur between roller 14 and foil 12. It has appeared that the major part of the tensile force in the foil is transferred through rotation of roller 14. For example, in the foil between roller 14 and machine surface 15 a tensile force of 10 kgf may be present, while in the foil between guide roller 14 and grips 20 and 22 only a force of 2 kgf is present. Therefore, chain 32 with sprocket wheel 33 provides a difference in tensile forces in the parts of the lower foil web 12 on both sides of roller 14 in such a manner that a reinforcing effect may be spoken of. The force as a whole is determined by the adjustable spring 30. Owing to this spring the desired force in the foil can be simply adapted to the width, the thickness and the resilient properties of the foil web, and also to the requirements set by the goods 7 to be packed. After the desired tension has been imparted to the lower foil web 12, during which the arms 24 seem to float and roller 26 has been released from the cam disc 25, the upper hold-down and stretch beam 10 is moved farther downwardly until the ledge 17 clamps the two foil webs on one another against the elastic pad 16. Then a known sealing and cutting means, for example an electrically heated wire mounted on a beam 40, moves upwardly till it abuts against a stop 41 at the bottom of beam 10. By this a heat-seal is effected between the two foil webs on the left and on the right of the wire, while between these seals the material is cut. The goods 7 are thereby firmly packed by the two foils being sealed in position around the goods, while the two foils 3 and 12 are sealed to one another again to receive the next goods to be packed. By means of the method and apparatus described, the desired tension in the foil is adjusted in the upper foil web and in the lower foil web independently of each other. After the foil has been properly tensioned the heat-seal proper is made, after the foil parts have been clamped with the clamping ledge 17 and clamping means 20 and 22, 5 and 4, respectively, have been released, so that the parts to be sealed are no longer subjected to stress in tension. When the lower foil web is tensioned, the greatest stress in tension is exclusively exerted on the foil part between guide roller 14 and the part of the foil on the machine surface 15, so that no unnecessary stretch or undue deformation of the foil material which is required for a next packing, takes place.

It is observed that in the embodiment given, the upper clamping means and the lower clamping and tensioning means are constructed differently. However, it is just as well possible to construct the two means substantially the same, provided only the tension in the two foil parts can be controlled independently. For example, for a tall product it may be advantageous to utilize, also for tensioning the lower foil web, a stretch beam to be moved along the goods, the seal being formed, for example, at the halfway level the packing.

I claim:

1. A method of wrapping goods to be packed with stretchable foil, comprising:

providing a first foil extending from a first supply roll, adjacent a clamping device, adjacent a hold-down and stretch beam and partially around goods to be wrapped, providing a hold down and stretch beam movable into engagement with the first foil, providing a second foil extending from a second supply roll to a guide roller and thence to a seal between the first and second foils, placing goods to be packed on a plate, with the first foil passing over the goods, providing a clamp for the second foil, providing a movable support for the clamp for the second foil to impart movement thereto, providing apparatus for cyclically moving the movable support and the clamp for the second foil, advancing the goods to be packed on the plate into the connected first and second foils, moving the holddown and stretch beam toward the plate and interrupting the movement thereof at a slight distance from the plate, effecting clamping of the first foil by the clamping device prior to the time when the movement of the stretch holddown beam is interrupted, to thereby stretch the first foil between the clamping device and the stretch and hold down beam, gripping the second foil by the said clamp when the clamp is supported in a position adjacent the plate, and moving the clamp to a position remote from the plate, rotating the guide roller at a higher speed than the speed of movement of the clamp, whereby to stretch the second foil between the goods and the guide roller and to provide therein a relatively great tension, and to stretch the second foil between the guide roller and the clamp for the second foil and to provide therein a relatively small tension, and sealing the two foils behind the goods.

2. A method of wrapping goods to be packed with stretchable foil, comprising providing a supporting plate for the goods, providing a first foil and a second foil having a heat seal between them and partially encompassing the goods in the said foils, extending the second foil from the goods to a guide and then from the guide to a clamp, causing the second foil between the goods and the guide to have a relatively great tension, causing the second foil between the guide and the clamp to have a relatively small tension to thereby stretch to a greater extent the foil used for the wrapping then being formed than the foil from the guide to the clamp, and thereafter sealing the two foils in position around the goods.

3. Apparatus for wrapping goods in stretchable foil comprising;

means for supporting the goods, a first supply roll for a first packing foil;

clamping means for clamping the first foil located intermediate the first supply roll and the goods;

stretch and hold down means for the first foil between said clamping means and the goods, a second supply roll for a second packing foil, guide means for the second foil adjacent the goods, and means including second clamping means located between said guide means and said second supply roll for selectively clamping the second packing foil and for causing a greater tension in said second foil between said goods and said guide means to stretch said greater tensioned foil and a lesser tension in said second foil between said guide means and said clamping means.

4. Apparatus as set forth in claim 3, and means for mounting said second clamping means for movement between a first position relatively close to said second foil guide means and a second position removed from said second foil guide means.

5. Apparatus as set forth in claim 4, said guide means comprising roller means adjacent said goods, means for causing the second clamping means to move from said first to said second position thereof, and means for causing said roller means to rotate simultaneously with the movement of said second clamping means with the peripheral speed thereof being greater than the rate of movement of said second clamping means from said first to said second position thereof.

6. Apparatus as set forth in claim 8, said roller means comprising a sprocket wheel having a diameter less than that of said roller means, a chain drivingly engaging said sprocket wheel, means connecting said chain for movement with said second clamping means, and a freewheel clutch means between said sprocket wheel and said roller means for driving said roller means upon movement of said clamping means from said first to said second position thereof.

* * * * *